United States Patent [19]

Schlichthorst

[11] Patent Number: 4,678,439

[45] Date of Patent: Jul. 7, 1987

[54] ENGINE INSTALLATION FOR USE IN A SHIP

[75] Inventor: Norbert Schlichthorst, Beckdorf, Fed. Rep. of Germany

[73] Assignee: Blohm & Voss AG, Hamburg, Fed. Rep. of Germany

[21] Appl. No.: 756,032

[22] Filed: Jul. 17, 1985

[30] Foreign Application Priority Data

Jul. 17, 1984 [DE] Fed. Rep. of Germany ..... 3426333

[51] Int. Cl.[4] ..... B63H 21/30

[52] U.S. Cl. ..... 440/11; 114/65 R; 114/77 R

[58] Field of Search ..... 114/77 R, 65 R, 269, 114/356; 440/75, 83, 111, 112; 248/638, 560, 580, 581, 610, 613, 634

[56] References Cited

U.S. PATENT DOCUMENTS

| | | | |
|---|---|---|---|
| 1,239,186 | 9/1917 | Jones | 440/83 |
| 1,824,887 | 9/1931 | Harvey | 440/112 |
| 2,059,220 | 11/1936 | Fernstrum | 440/111 |
| 2,595,863 | 5/1952 | Loofbourrow | 440/83 X |
| 3,170,435 | 2/1965 | Najimian, Jr. | 440/111 X |
| 3,501,929 | 3/1970 | Kashmerick | 440/900 X |
| 3,858,411 | 1/1975 | Hiersig et al. | 64/1 R |
| 3,930,379 | 1/1976 | Hiersig et al. | 64/11 R |
| 3,943,586 | 3/1976 | Palmer | 114/356 |
| 3,962,933 | 6/1976 | Wedler | 74/665 GA |
| 4,003,330 | 1/1977 | Compton | 115/0.5 B |
| 4,188,833 | 2/1980 | Krauss et al. . | |
| 4,229,990 | 10/1980 | Steinberg et al. | 74/377 |
| 4,274,827 | 6/1981 | Catsburg | 440/54 |
| 4,290,270 | 9/1981 | Mech | 60/716 |
| 4,309,914 | 1/1982 | Hiersig et al. | 74/15.4 |
| 4,368,048 | 1/1983 | Wedler | 440/75 |
| 4,406,633 | 9/1983 | Hamm | 440/75 |
| 4,412,500 | 11/1983 | Krautkremer | 114/151 |

FOREIGN PATENT DOCUMENTS

| | | | |
|---|---|---|---|
| 319981 | 4/1920 | Fed. Rep. of Germany . | |
| 2310912 | 9/1973 | Fed. Rep. of Germany . | |
| 2303723 | 6/1974 | Fed. Rep. of Germany . | |
| 3013609 | 10/1980 | Fed. Rep. of Germany . | |
| 1032427 | 6/1966 | United Kingdom | 440/83 |

OTHER PUBLICATIONS

"Efficient Combined Power Propulsion and Steering", Schottel Information Letter, Sep. 1968, No. 24.

*Primary Examiner*—Sherman D. Basinger
*Attorney, Agent, or Firm*—Nils H. Ljungman

[57] ABSTRACT

An engine installation for ships with a prefabricated box-like engine module container with an engine and a transmission installed therewithin. The module encloses the engine and the transmission, and has a shaft installation for connection to a main propeller of the ship. The prefabricated module is suspended from an upper portion thereof by force bearing members rigidly mounted on the ship. Between the module and torque transmission equipment rigidly mounted on the hull, there is an axial-radial alignment equalization torque transmitting link.

42 Claims, 14 Drawing Figures

ENGINE INSTALLATION FOR USE IN A SHIP

BACKGROUND OF THE INVENTION

1. Field of the Invention

The invention relates to an engine installation for driving propellers of ships, and more particularly, to a modular engine installation for ships.

2. Description of the Prior Art

Engine installations are generally installed on foundations prepared in the ship, and subsequently connected with the required supply lines. A disadvantage with the previously known configuration of engine installations is both the relatively difficult and expensive installation, and the difficulty of replacing machine parts which have become defective. In addition, with the known engine installations, a very significant transmission of noise and vibrations to the hull takes place.

German Patent No. DE-PS 319 981, incorporated herein by reference, includes an engine installation for ships and airplanes in which the drive engine is mounted in an elastically-suspended cradle, which can swing freely in all directions, so that movements of the motor cannot be transmitted to the hull or fuselage. But a disadvantage with the known drive apparatus is that it can only be installed and fastened in place before the deck is installed, and that the suspension on the springs is both very difficult to execute and leads to a much too unstable suspension, which can even result in a buildup of resonance vibrations at certain frequencies.

Some examples of transmission of ships are U.S. Pat. Nos. 4,309,914; 4,229,990; 4,188,833; 3,962,933; 3,930,379; and 3,858,411. Some examples of engine installations on ships are U.S. Pat. Nos. 4,412,500; 4,406,633; 4,368,048; 4,290,270; and 4,274,827. All of the above-cited U.S. Patents are incorporated herein by reference.

OBJECTS OF THE INVENTION

An object of the invention is, therefore, to produce an engine installation for ships which is easy to install and to remove.

A further object of the invention is to produce an engine installation in which the transmission of noise and vibrations to the hull is reduced.

A yet further object of the invention is to produce an engine installation which does not build up motor vibrations.

A still further object of the invention is to produce an engine installation on which service, repair and overhaul activities can be performed in a very economical manner, and especially when removed from the ship.

It is a yet additional object of the invention to produce an engine installation which is designed in a compact manner.

It is a still further object of the invention to produce an engine installation which assures a high degree of operating safety even when damaged, for example, in the case of fire, in battle, or if leaks occur.

SUMMARY OF THE INVENTION

To achieve these objectives, the invention provides that at least the motor is located in a box-like module, which is suspended from above on force bearing members, which are firmly attached to a deck of the ship. The invention additionally provides an axial-radial alignment equalization torque transmitting link, located between the module and the torque transmission apparatus, the torque transmission apparatus being firmly mounted on the ship's hull. The deck of the ship above the module has an opening with a larger cross section than the box-like module. This opening can be closed by a removable cover. Preferably, there is disposed a ring gasket between the cover and the periphery of the opening.

The preferred embodiment is one in which the transmission is also located in the module and the axial-radial alignment equalization link is located between the transmission and the shaft outside the module. The axial-radial alignment equalization link, in this case, should specifically be formed by two univeral joints located at some axial distance from one another, with an axial equalizer being located between them.

Another advantageous embodiment of the invention resides in the shaft behind the axial-radial alignment equalization torque transmitting link comprising a combined radial-axial thrust bearing fastened to the hull, with which a screw adjustment apparatus is specifically combined.

The theory of the invention is, therefore, that a compact, preferably rectangular shaped module containing at least the most important parts of the engine installation can be placed in the hull as a prefabricated unit. All the supply lines can then be connected by means of one or two interfaces to the installed module. The module also has a control unit, which can operate in analog or digital modes. The motor should be able to be started inside the module, whereby compressed air conducted into the module can be used for assistance in starting. In this manner, it is possible to have the motor running for test purposes even when the module is outside the ship.

When a hydrostatic transmission is used, the axial-radial alignment equalization link can also be activated by the hoses connecting the hydraulic pump and the hydromotor.

A special advantage of the configuration proposed by the invention is that the motor and transmission need not be oriented relative to the shaft. The fastening in the upper region of the module results in easier installation. In addition, the vibration behavior of the module is favorably effected.

As a result of the axial-radial alignment equalization link between the module and the shaft, a satisfactory torque connection is achieved between the module, which is preferably suspended in a manner which attenuates vibrations, and the shaft fixed in the hull. The damped elastic suspension in the upper region can be realized in a particularly compact and stable manner.

A preferred embodiment of the invention has the force bearing members designed as oblong plates and, extending laterally beyond the brackets, being attached to longitudinal spars below the deck of the ship, whereby preferably the cover is able to be mounted flush with the deck of the ship.

To attenuate lateral vibrations of the module, in one alternative embodiment of the invention, there are provided lateral support bearings acting laterally upon the lower region of the module and fastened to the hull. This can be realized, for example, by having the lateral support bearings include a bearing foot fastened to the ship's hull with a lateral shock absorber between the bearing foot and the side of the module. To avoid any subsequent installation work in the lower region of the module, a particularly preferred and practical embodiment of the invention has each lateral shock absorber fastened to the bearing foot, and only in contact with the module, preferably with a shield plate.

To be able to attenuate any vibration of the module which may occur in the longitudinal direction of the ship, a preferred embodiment of the invention has, in the upper region of the module, axial shock absorbers between the module and a support fastened to the hull of the ship. These shock absorbers act fore and aft along the longitudinal direction of the axis of the ship. To facilitate installation, this embodiment also provides that the axial shock absorbers are fastened to the hull of the ship, and are only in contact with the module, preferably with a shield plate specially provided for this purpose.

In a particularly preferred embodiment of the module, according to the invention, the module is designed as a box frame, which is preferably composed of standard commercially available structural members. Standard profiles can be used therefor, which means that the box frame can be fabricated very economically.

Machine foundations are appropriately installed on the longitudinal bottom beams of the box frame. The machine foundations can specifically be realized by having the longitudinal floor beams supplemented by welded-on sheets forming box spars, whereby the box spars are appropriately designed as oil tanks. In this manner, the fresh oil/used oil or dry sump method of operation can be used wholly inside the module.

According to the invention, the box frame is preferably designed so that none of the components penetrate the side or top and bottom of the module.

The box frame should also have a fixed installed floor of metal or a metal sandwich construction.

. It is also appropriate if the box frame is lined preferably in a smooth manner with acoustical and thermal insulation. Metal sandwich elements can be used, which can be installed in a water tight manner. This makes safe operation possible, even when the engine room areas and engine rooms are flooded. The sandwich lining can also be used with an appropriate ceramic coating for protection against fire and also against chipping. If the module is completely lined, a module ventilation system is used. Cold incoming air is conducted through an expanded air inlet duct, namely by means of a separate ventilator with a preferable pressure of approximately 500 millimeter column of water. Hot air from the inside of the module can be discharged by means of an ejector with a check valve through the exhaust pipes.

With a closed module, it is also advantageous if the drive shaft of the transmission or of the motor extends through the back wall of the box frame enclosed in a bulkhead pipe fitting.

On smaller ships generally having a displacement of less than 500 tons, in which the height of the engine room corresponds to the interval between two decks, the invention provides that, in addition to the motor and the transmission, all the auxiliary equipment, such as exhaust equipment, air intake ducts, coolers, etc., is located in the module. In addition to the motor and the transmission therefor, other auxiliary equipment, such as heat exchangers, sea water coolers, fresh water coolers, and oil coolers, plus any spare pumps and fans, are installed in the module. The supply lines are introduced and connected centrally by means of a terminator with fast-release couplings and hose connections or compensators. The necessary electrical feed is supplied by means of a second terminal, which is a component of the locl control stand. The fluid termination is preferably amidships on the long side of the module, while the electrical terminal is located with the control stand on the short side of the module.

The smaller ships, for which the modular system described by the invention is designed, have the following special criteria:

relatively high average long-term load;
short service intervals;
high impact load; and
high noise output.

In such smaller ships, the module is suspended from above, flush with the topmost deck, and is preferably made both gas-tight and watertight. The opening provided in the deck for the installation of the module is then closed tightly by a cover. In very small ships, in which the height of a deck is not sufficient for the installation of a module, the panel bearings can be provided at the deck height, and the cover can be fastened on the upper edge of a coaming surrounding the opening.

The invention is applicable to larger ships, too, wherein the engine room extends over two or more decks, for example, on corvettes with up to 1000 ton displacement. In this case, several modules are located above one anoher, whereby each individual module is suspended on one of the decks and contains a portion of the engine installation.

For example, the motor and transmission preferably are disposed in the lowermost module. In the module thereabove, the exhaust and air intakes and the electrical generator preferably are disposed. In the uppermost module, the air conditioning equipment is preferably disposed. Thus, a series of small, compact engine rooms can be formed one above the other, which can form an installation similar to an upside-down pyramid, to allow installation or extraction from above through the deck above.

The invention therefore provides for the easy insertion and extraction of modules above one another, in that the modules from bottom to top have a successively increasing horizontal cross section. This provides that the lower module can be inserted or extracted through an opening in the modules thereabove.

It is particularly advantageous if the motor and/or the transmission are mounted resiliently or elastically inside the module. Because of the elastic suspension of the module itself, a resilient or elastic mounting is preferred, even though a rigid mounting of the motor and/or transmission in the module is possible. Thus, a double elastic mounting is possible without additional expense. Basically, however, the module can also be fastened rigidly in the hull of the ship.

According to the invention, the weight distribution between the machines and the box frame, including the auxiliary equipment, can be advantageously selected. The weight of the damping mass can be 10 tons, for example, and the weight of the box frame with the auxiliary equipment 5 to 7 tons, so that a ratio of the damping mass weight to the dead weight can be approximately 2:1 to 1.5:1. It is particularly preferred if the ratio of the weight of the motor to the remaining weight of the module is 3:1 to 1:1, especially 2:1.

Another essential characteristic of the modular construction proposed by the invention includes the separation of the thrust bearing and transmission by the arrangement of the axial-radial equalization link.

The design proposed by the invention makes possible a fast and easy installation and removal of the drive machines and the transmission during start-up and maintenance activities. This saves time and money. If damage occurs, it is possible to replace the motor or transmission in a short time, and expensive and time-consuming repair activities can be eliminated.

Essentially, however, the thrust bearing could remain in the transmission, and the module can simply be elastically located in the ship. There is a "Silentbloc"-type rubber-metal connection to absorb the thrust on the short-side of the module in the lower frame plate. However, this requires an orientation of the module in the ship corresponding to the orientation of the shaft. The standard mounting on shock-absorbers or the double-elastic mounting with a correspondingly soft tuning and suspended installation makes possible more economical designs. Above all, it allows the use of economical, available individual components, since the maximum impact loads occur on the outer skin and on the bottom of the ship. The radiation of noise through the ship is also more favorable and reduced. "Silentbloc"-type connections are made by Silentbloc Limited, of the environs of Crawley, England. An example of marine engine mounts manufactured by Silentbloc Ltd. is described in U.S. Pat. No. 4,003,330, which patent is incorporated herein by reference.

The design of the module means can be such that the machine room can be completely equipped in advance, before the prefabricated module is placed in the hull. The shaft line equipment is also simplified considerably, since it need only be installed to the thrust bearing.

The size of a module for the installation of an engine, a transmission, an exhaust silencer and an intake line can be, for example: length 5.4 meters, width 2.1 meters, height 3.6 meters.

A special advantage of the modular system described by the invention is that the engine rooms can be kept extremely small, since a major portion of the replacement activity can be performed in only a few hours. Even unscheduled repairs can be performed easily, by removing a module from the ship and inspecting it, either on deck or on the dock. If several modules are located one above the other, the lower modules can be made easily accessible by removing the upper modules. The invention therefore creates, for the first time, complete replacement capability for the engine installation.

The engine room can be completely pre-fabricated outside the ship, including all the pipelines. Even the painting and marking work can be done outside the ship.

According to the invention, the use of shock absorbers instead of springs assures an elastic or resilient mounting, which does not have the inherent danger of the buildup of vibrations, by simultaneously including a damping component.

BRIEF DESCRIPTION OF THE DRAWINGS

The invention is described below on the basis of examples and with reference to the drawings, in which.

DESCRIPTION OF THE PREFERRED EMBODIMENTS

Figure 1:
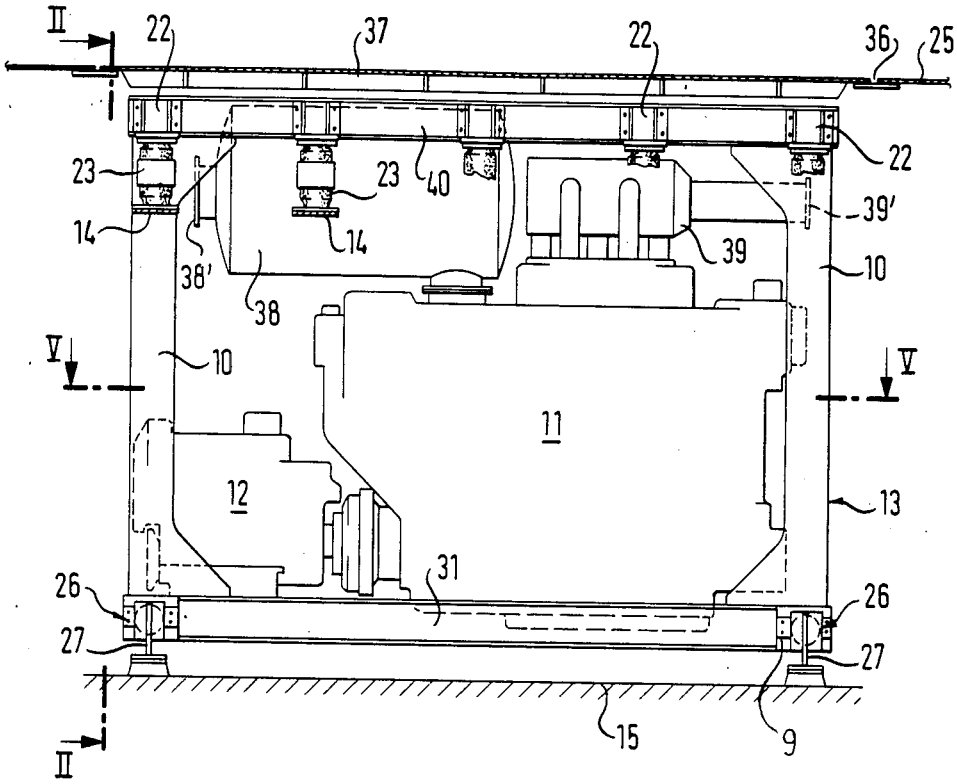
FIG. 1 shows a side view in partial section of a modular engine installation according to the invention.

As shown in FIGS. 1 to 7, the rectangular module 13 according to the invention includes a box frame with several longitudinal floor beams running parallel to one another, being made by floor and cover plates 32' or 32'' into box spars 32, which box spars 32 can be used as oil tanks. The longitudinal floor beams 31 are firmly connected fore and aft by crossbeams 9. There are vertical beams 10 on the four corners, which are fastened above to the corners of a rectangular frame, which comprise longitudinal beams 40 at a lateral interval, and crossbeams 40' connecting the latter fore and aft. The longitudinal beams 31 form a foundation for an engine 11 and a transmission 12 located behind it. In the upper region of the module 13, there is also a silencer or muffler 38, a connection flange 38' which empties in the vicinity of the rear surface of the module 13, and an air intake duct 39. A connection flange 39' empties in the vicinity of the front surface of the module 13. The engine 11 and transmission 12 are connected to one another by a shaft 55 (shown in FIG. 10).

Figure 2:
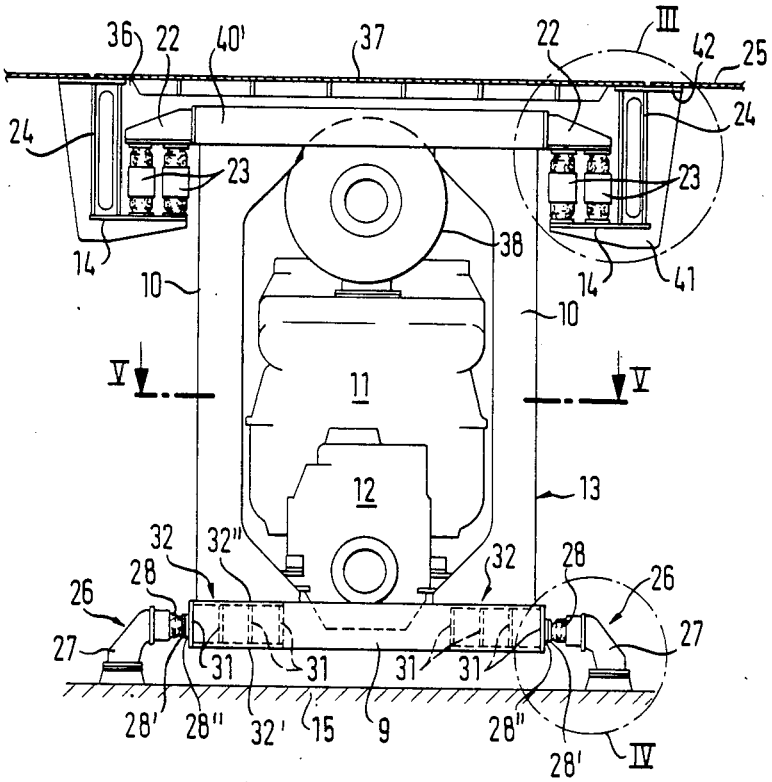
FIG. 2 shows a rear view in partial section of the engine installation according to FIG. 1, along Line II—II in FIG. 1.
Figure 3:
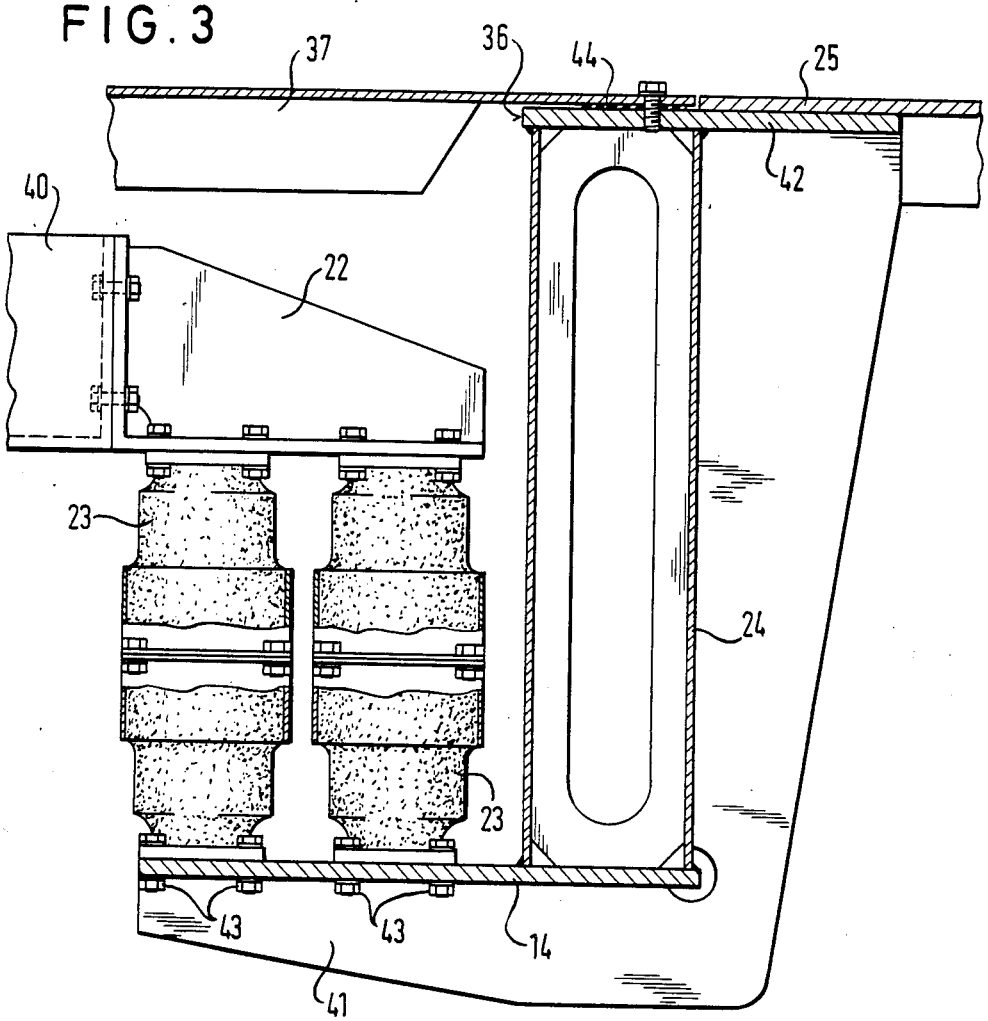
FIG. 3 shows Detail III from FIG. 2, on an enlarged scale.
Figure 6:
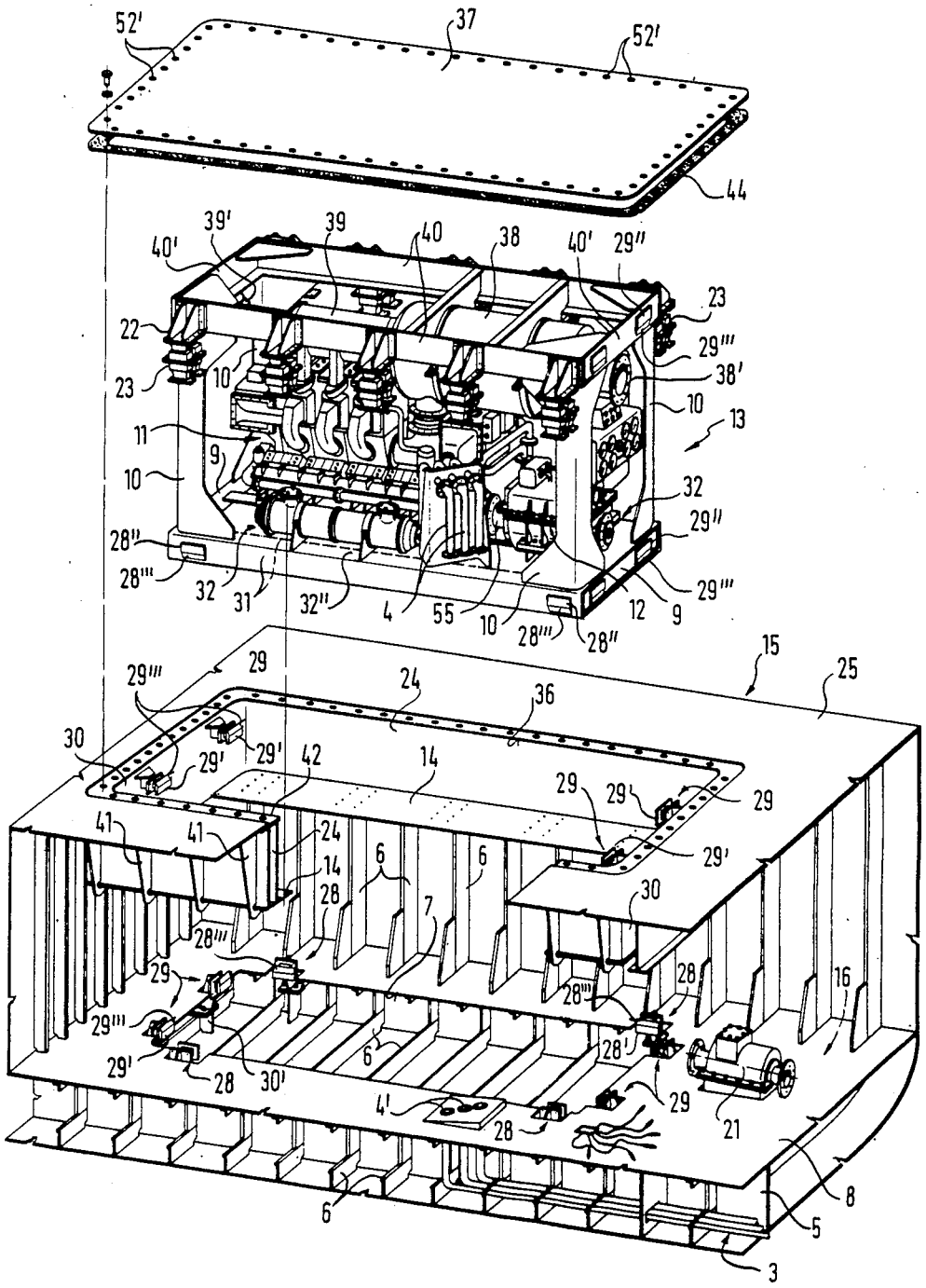
FIG. 6 shows a perspective view of the engine installation described in FIGS. 1 to 5 with the surrounding portions of the hull of the ship, in an exploded view.

According to FIGS. 1 to 3 and also FIG. 6, the upper longitudinal beams 40 of the box frame forming the module 13 have brackets 32 which project therefrom laterally. Two vertical shock absorbers 23 are shown fastened underneath the brackets 22. The shock absorbers 23 are parallel to one another and next to one another, and are fastened thereon at a distance related to their length. Th shock absorbers 23 are attached to a force bearing member 14 which is rigidly mounted to the ship and forming part of a horizontal plate. Each force bearing member 14 projects laterally to the shock absorbers 23 and is fastened to the shock absorbers 23 at the bottom thereof. A longitudinal spar 24, attached to the force bearing member 14, is shown in FIGS. 3 and 6. The longitudinal spar 24 is fastened at its top to the underside of a deck 25 of the ship, by means of a ring plate 42 surrounding the deck opening 36 which is designed to be somewhat larger than the module 13. At certain intervals in the longitudinal direction of the ship, there are reinforcement plates 41 on the outside of the longitudinal spars 24 and the force bearing members 14, perpendicular to the force bearing member 14 and to the longitudinal spars 24 which, as shown in FIGS. 3 and 6, surround the force bearing member 14 and the longitudinal spar 24 at right angles. Along each upper longitudinal beam, there are typically five brackets 22, each with two shock absorbers 23 evenly distributed next to one another. The entire weight of the module 13 and of the parts inside hangs from the brackets 22.

Figure 5:
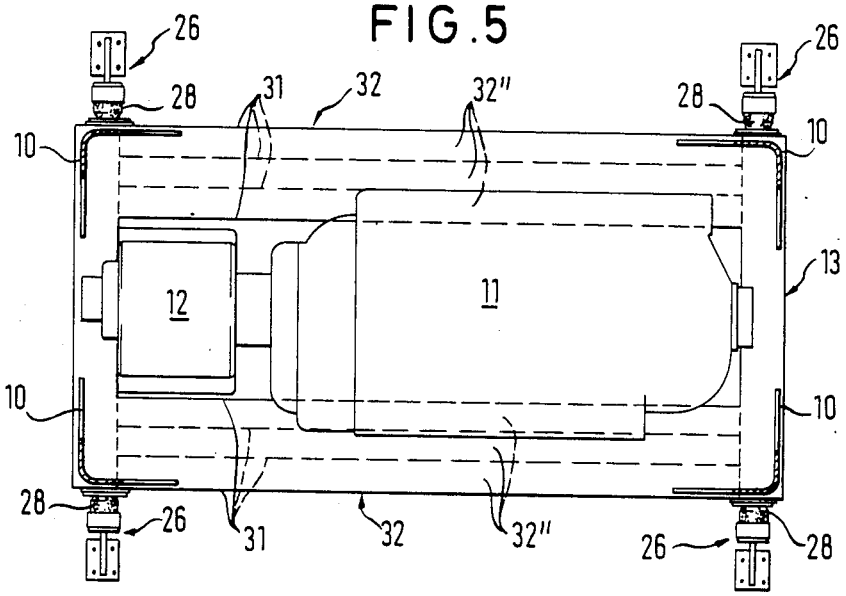
FIG. 5 shows an overhead view in partial section of the item illustrated in FIGS. 1 and 2 along Lines V—V in FIGS. 1 and 2.
Figure 4:
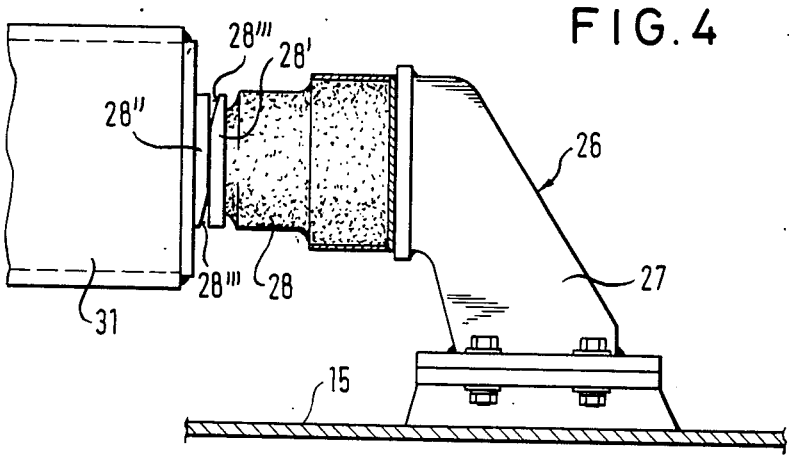
FIG. 4 shows Detail IV from FIG. 2, on an enlarged scale.

As shown in FIGS. 2, 4 and 5, lateral supports 26 engage the lower longitudinal beams 31 laterally in the area of the four corners, which comprise a bearing foot 27 fastened to a hull member 15, and lateral shock absorbers 28 located between the bearing foot and the longitudinal floor beams 31. In this manner, lateral vibrations of the module 13 are attenuated in the lower region of the module 13. The lateral shock absorbers 28 are firmly connected to the bearing feet 27 and, on their ends facing the module 13, have bearing plates 28' running parallel to the corresponding lateral surfaces of the module 13. As shown in FIG. 6, corresponding to the bearing plates 28' on the longitudinal beams 31, there are shield plates 28'' running parallel. When the module 13 is installed, the plates 28' and 28'' are in close contact with one another.

As shown in FIG. 6, between the upper crossbeams 40' or the lower crossbeams 9 and the pipes 30, 30' mounted rigidly on the ship, there are axial shock absorbers 29, to attenuate longitudinal vibrations of the module 13.

The axial shock absorbers 29 are also provided with terminal plates 29', which interact with shield plates 29'' on the module 13, so that when the module 13 is installed, they come into contact with the shield plates 29''.

As shown in FIGS. 2, 3 and 6, there is an opening 36 in the deck 25 above the module 13, which corresponds to the cross section of the module 13 including the brackets 22, through which the complete module 13, including the drive equipment in it, can be introduced into the hull of the ship, until the vertical shock absorbers 23 come into contact with the force bearing members 14, where they are fastened by means of screws 43 (shown in FIG. 3). The opening 36 can then be closed watertight by means of an appropriately-shaped cover 37, having a gasket 44 interposed between the cover 37 and an edge of the opening 36 (shown in FIGS. 3 and 6).

As shown in FIG. 6, according to the invention, there is a rectangular opening 7 in the inner bottom plating 8 of the hull 15, corresponding to the horizontal cross section of the module 13, in which the floor frame of the module 13 engages the beams 9 and 31 preferably by means of brackets, and at which level there are lateral shock absorbers 28.

FIG. 6 also shows the spars 6 and longitudinal beams 5 of the hull 15.

As shown in FIG. 6, cooling water hoses 4 can be attached to the side of the module 13, and can be connected to appropriate connection flanges 4' in the inner bottom plating 8 next to the rectangular opening 7, to supply the engine 11 located in the module 13 with cooling water, which enters the exits via lines 3 from the cooling water entry and exit points (not shown in the drawing).

Figure 7:
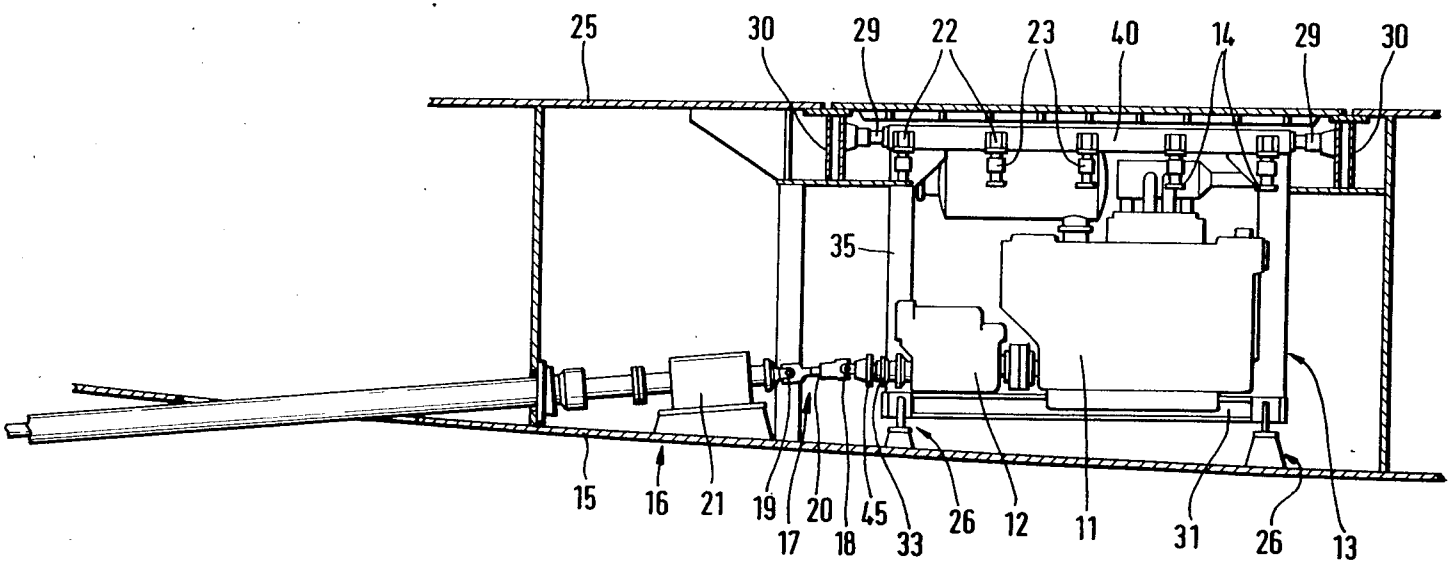
FIG. 7 shows a side view in partial section of the engine installation complete in a ship's hull, according to the invention.

As shown in FIG. 7, below the deck 25 of the ship, there is a fixed shaft installation 16 and which comprises the radial-axial thrust bearing 21. The shaft installation 16 is connected by a shaft to one of the primary propellers of a large ship, or the single propeller of a small ship. The shaft installation is behind the rectangular module 13, which module 13 is suspended under the deck 25 of the ship. The shaft installation further comprises an axial-radial alignment equalization link 17 between the transmission 12. The axial-radial alignment equalization link 17 typically comprises two universal joints 18 and 19, located at some distance from one another with an axial displacement equalization shaft 20 between them. The axial shaft 20 may be, for example, a circular gear sleeve coupling.

Between the axial-radial alignment equalizing link 17 and the output shaft 33 of the transmission 12, there can also preferably be an elastic intermediate coupling 45.

In the embodiment illustrated in FIGS. 1 to 7, the module 13 is open on all sides, whereby special emphasis is placed on a substantially perfect seal between the cover 37 and the deck 25 of the ship.

The total shaft installation 16 is installed before the installation of the module 13 in the hull of the ship. After the insertion and fastening of the module, all that needs to be coupled is the output shaft 33 of the transmission 12 with the shaft installation 16 or with the radial-axial thrust bearing 21 mounted in the inner bottom plating 8, via the axial-radial alignment equalization link 17.

To extract the module 13, the coupling with the shaft installation 16 need only be loosened, whereupon, after the cover 37 is removed, the supply lines and the connecting screws 43 (as shown in FIG. 3) between the module 13 and the force bearing member 14 are loosened, and the module 13 can be removed from the hull by means of a hoist. No manipulations need be done on the shock absorbers 28 and 29. If necessary, the insertion can be facilitated by the introduction slides 28''' and 29''' above or below to the plates 28' and 28'' or 29' and 29''.

Figure 8:
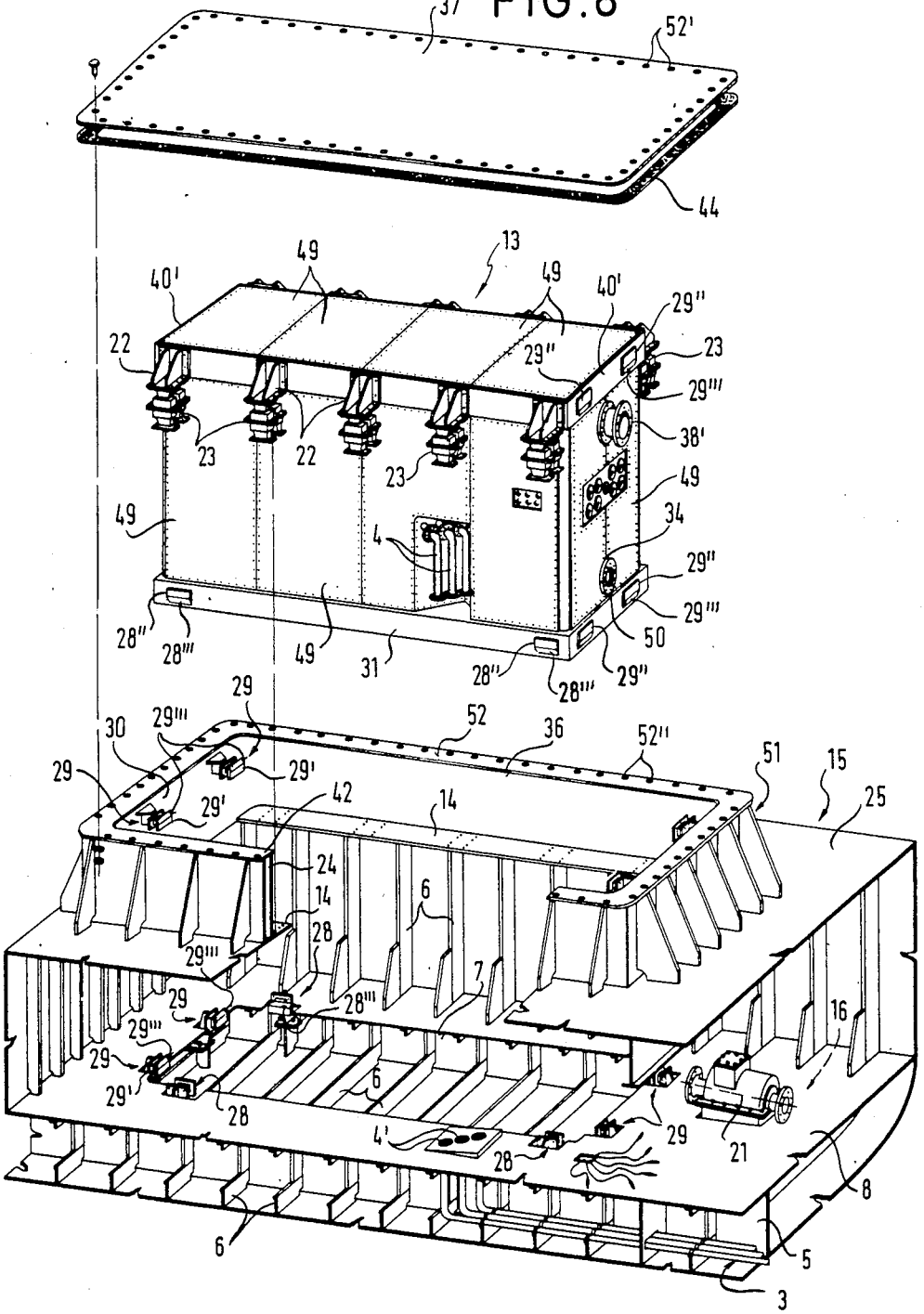
FIG. 8 shows a perspective view analogous to FIG. 6 of another embodiment.

The reference numbers in FIG. 8 identify the same parts as in the preceding figures.

In addition to the embodiment described above, however, in another embodiment the module 13 is completely surrounded by watertight, and preferably also soundproof, lining plates 49, from which only the various connections, such as the exhaust tube connection flange 38', cooling water connection tubes 4 and the connection flange 50 of the transmission 12 exit. Because of the hermetic seal of the module 13, if water penetrates into the engine room, the engine 11 with its associated installations remains completely operational, which is of special importance in military or naval ships, which may be exposed to gunfire or mine explosions. The shaft connection pipe 50 is conducted, as shown in FIG. 8, through a watertight bulkhead pipe fitting 34.

In the embodiment illustrated in FIG. 8, the force bearing members 14, designed as rectangular plates and located beside the deck opening 36, are not located under the deck 25, but at the level of the deck 25. To make sufficient room for the upper frame of the module 13 located above it, which comprise beams 40 and 40', the deck opening 36 is surrounded by a coaming 51, the upper edge 52 of which is designed as a contact surface for the ring gasket 44 and the cover 37. In the embodiment illustrated in FIG. 8, therefore, the cover 37 is fastened to the surface 52 of the coaming 51 by means of bolts introduced into holes 52' and 52''. This embodiment is particularly well-suited for ships in which the height between the inner bottom plating 8 and the deck 25 is not altogether sufficient for the introduction of the engine installaion. From the point of view of stability, the embodiment illustrated in FIG. 8 is preferred, because the forces transmitted by the module 13 to the hull of the ship 15 are transmitted to the ship directly at the level of the deck, so that no intermediate elements are necessary, such as the longitudinal spar shown in FIG. 6.

Figure 9:
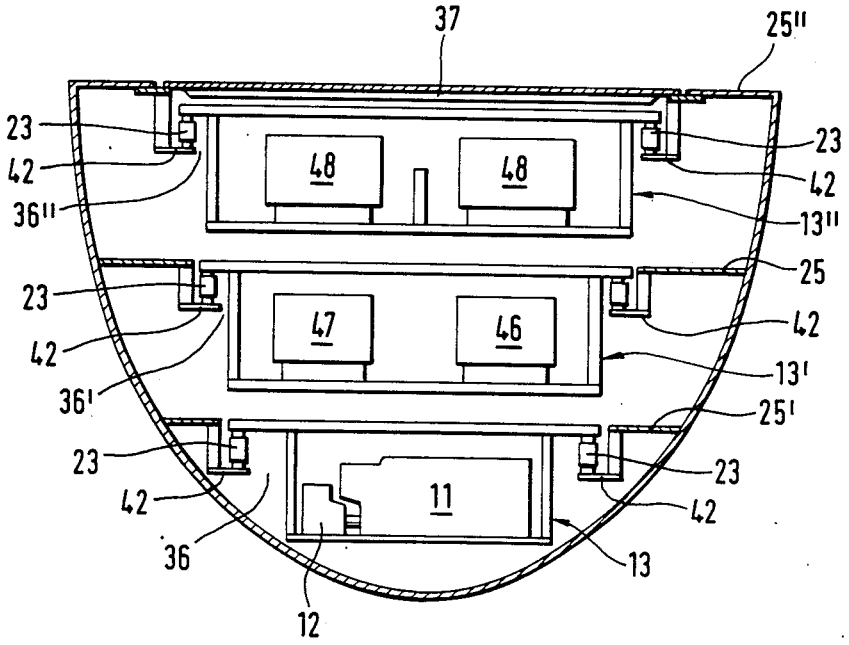
FIG. 9 shows a schematic section of a ship, perpendicular to a longitudinal axis, with an engine installation distributed over several modules arranged one on top of the other.

As shown in FIG. 9, with a larger ship, three modules 13, 13' and 13'' are suspended above one another on three decks 25, 25' and 25'' located above one another. So that the bottom modules 13 and 13' can be extracted from above after the removal of the top module 13' or 13'', the horizontal cross sections of the module 13, 13' or 13'', as well as the deck opening 36, 36' or 36'', are correspondingly larger, from bottom to top.

While the engine 11 and the transmission 12 are in the lower module 13, the middle module 13' can contain, for example, the generator 46 and the incoming and outgoing air installation 47, while the upper module 13'' can contain the air conditioning installation 48. The entire arrangement is again closed by a sealed cover 37. The engine 11 and the transmission 12 in the lower module 13 are shown rotated 90° in FIG. 9. The actual orientation of the engine 11 and the transmission 12 is parallel to the length of the ship as is shown in FIG. 6. This rotation of the lower module 13 has been made in order to indicate clearly that the engine 11 and the transmission 12 are found in the lower module 13.

Figure 10:
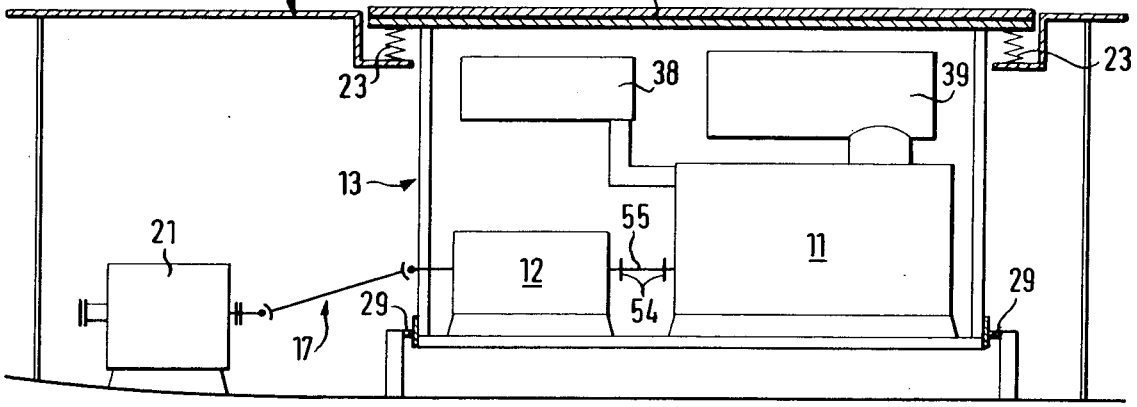
FIG. 10 shows a schematic side view of a preferred embodiment of a modular drive aggregates according to the invention, whereby there are silencers and air intake ducts in the module.

FIG. 10 shows another schematic illustration of a preferred embodiment of the engine installation described by the invention, where the same reference numbers identify the same parts as in the preceding embodiments. FIG. 10 shows especially clearly that the entire module 13, including the arrangements inside such as the engine 11, transmission 12, silencer 38 and air intake duct 39, is suspended elastically by the vertical shock absorbers 23 on the ship's hull 15. The shock absorbers 23, according to the invention, typically should have a travel of 30 to 70 millimeters.

Figure 11:
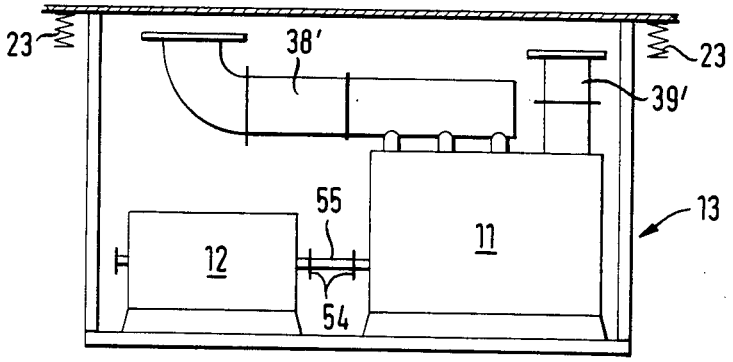
FIG. 11 shows a schematic partial side view of a modular drive aggregate according to the invention, but in the module there are only the feed lines for the silencers and for the air intake ducts.

FIG. 11 schematically shows an embodiment in which only the engine 11 and transmission 12 are located inside the module 13, while the silencer and the air intake ducts are outside the module 13, in a manner not shown, whereby the lines 38' and 39' for connection to these installations are located inside the module 13, as indicated in FIG 11.

Figure 12:
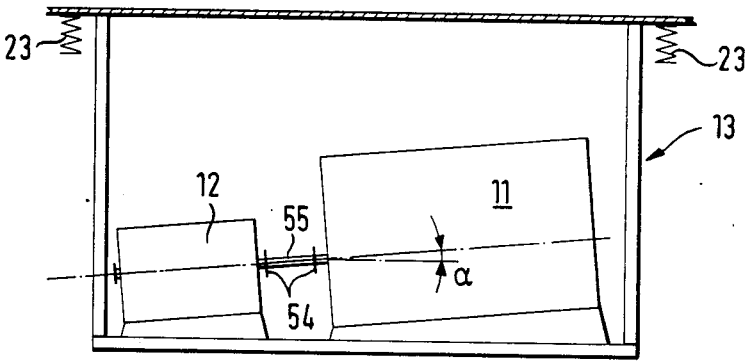
FIG. 12 shows a schematic side view of a module according to the invention with an oblique engine and transmission.

The embodiment illustrated in FIG. 12 shows that the engine 11 and the transmission 12 can also be arranged at an angle "alpha" to the longitudinal axis of the ship, so that the ship's shaft can be directly connected via the radial-axial thrust bearing 21 to the transmission 12, without any directional deviation.

Figure 13:
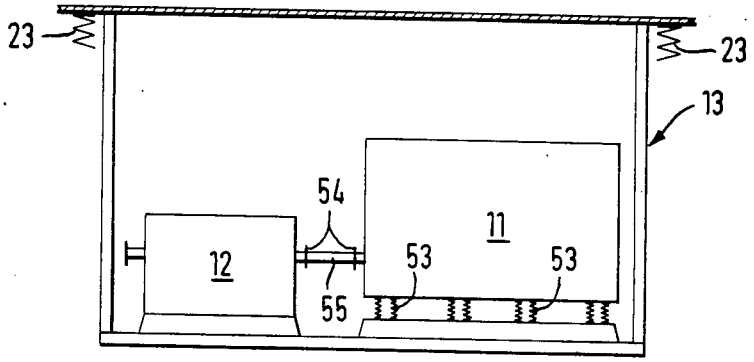
FIG. 13 shows a schematic side view of a module according to the invention containing the engine and transmission, whereby the engine is elastically mounted on the module.

A particularly preferred embodiment is illustrated in FIG. 13, which shows a double elastic bearing of the engine 11, in which the engine 11 is mounted on elastic elements 53 on the foundation of the module 13, while the transmission 12 is rigidly mounted on the floor frame of the module 13. To prevent the transmission of vibrations via the connection shaft 55 between the engine 11 and the transmission 12, elastic intermediate pieces 54 are built into the connection shaft 55, which are still able to transmit the required torques, and can also be present on the embodiments described in the preceding figures.

A particularly good vibration damping is achieved if the remaining weight of the module 13, that is, its weight with the exception of the weight of the engine 11, amounts to approximately 50% of the weight of the engine 11. If necessary, there is a corresponding vibrational damping mass in the foundation of the module 13, for example, in the form of concrete, to maintain this optimal weight ratio between the engine 11 and the remaining weight of the module 13.

Figure 14:
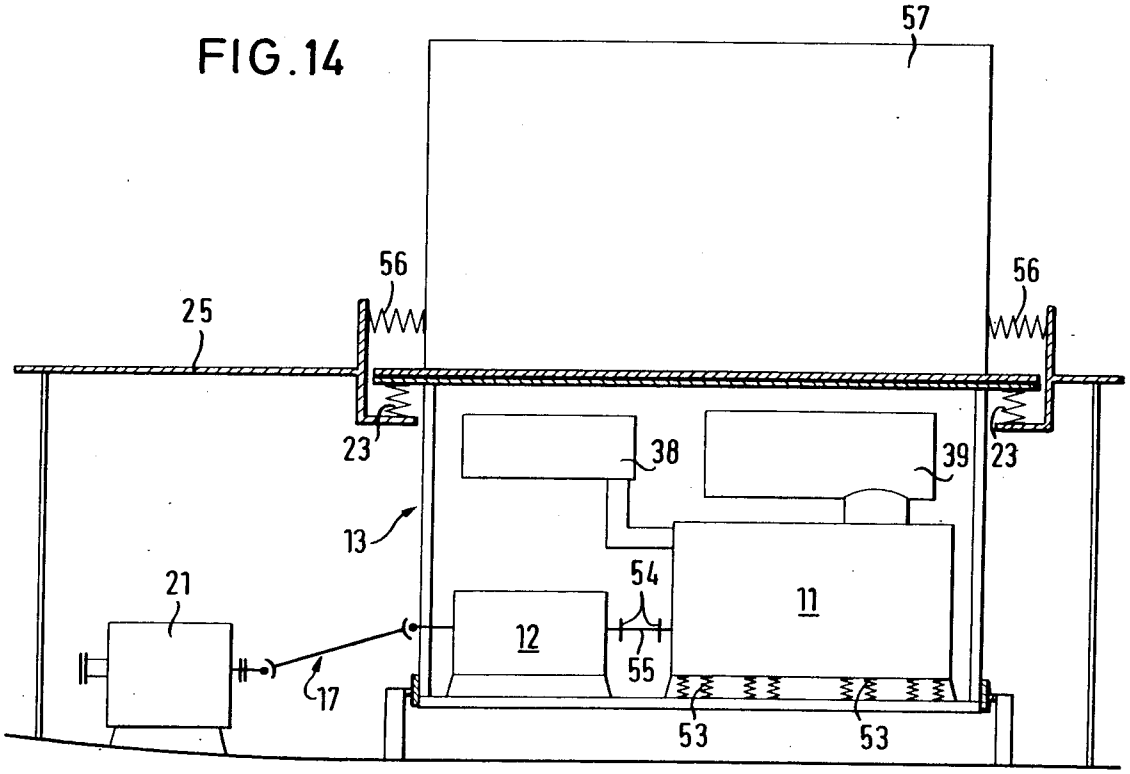
FIG. 14 shows a schematic side view of another advantageous embodiment of the modular engine installation according to the invention, whereby there is a container containing additional apparatus and equipment on the module containing the engine and the transmission.

This favorable weight ratio can be achieved, as shown in FIG. 14, by a container 57 placed on top of the module 13, so that no special dead weights need be provided in the module 13.

The container 57, which can, for example, contain an electrical generator or other equipment, can also be elastically supported by means of damped elastic support 56 in the lower region of the ship's deck 25. This embodiment can be advantageously applied if there is no elastic support 53 of the engine 11 on the floor of the module 13.

To create a sufficient seal in the area of the container 57 against the inside of the hull, the elastic support 56 is preferably designed as a circular elastic seal; the container 57 is thus in rigid contact with the module 13, but is in elastic and sealed contact with the deck 25 of the hull.

The invention as described hereinabove in the context of a preferred embodiment is not to be taken as limited to all of the provided details thereof, since modifications and variations thereof may be made without departing from the spirit and scope of the invention.

What is claimed is:

1. A modular engine installation for driving a ship through water, said ship having hull means with a plurality of decks and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said prefabricated modular container, said means for attaching being disposed at an upper portion of said prefabricated modular container, and for being disposed below an upper portion of said opening means to suspend said prefabricated modular container in said hull means;

said engine means having means for transferring torque to said propeller means of said ship;

said propeller means being separate from said modular engine installation and being attached to said hull;

said prefabricated modular container having means for permitting said torque transferring means to pass therethrough;

removable cover means for covering said opening means in said hull means, at least when said prefabricated modular container is disposed in said hull means of said ship; and said prefabricated modular container being insertable in and completely removable from said opening means and said hull means of said ship, substantially in toto, with said engine means being contained in said prefabricated modular container, whereby time required for refitting of said modular ship engine installation is minimized.

2. The modular engine installation according to claim 1 wherein said prefabricated modular container has a lower portion.

3. The modular engine installation according to claim 2 wherein said engine means comprises an engine and a transmission, and said torque transferring means comprises means for compensating for axial and radial misalignments between said modular container and said hull means.

4. The modular engine installation according to claim 3 wherein said means for compensating for axial and radial misalignments comprises at least two universal joints and means for compensating axial distance variations, said means for compensating axial distance variations having at least one of said universal joints at a predetermined distance one from the other.

5. The modular engine installation according to claim 4 including support means disposed at said lower portion of said prefabricated modular container for substantially stabilizing said prefabricated modular container with respect to said hull means in a substantially horizontal direction, whereby lateral movements of said prefabricated modular container are minimized.

6. The modular engine installation according to claim 3 wherein said prefabricated modular container has one dimension longer than other dimensions thereof, and wherein said engine and said transmission in said engine means are mounted horizontally; said prefabricated modular container having said longer dimension horizontally disposed, and said means for compensating for axial and radial misalignments having means for adjustment of shaft inclination.

7. The modular engine installation according to claim 2 including bearings for firm attachment to said hull means.

8. The modular engine installation according to claim 7 wherein said hull means comprises at least one deck, said at least one deck including means for attachment to said bearings.

9. The modular engine installation according to claim 2 wherein said hull means has torque transmission equipment for transmitting torque to said propeller means, and means for rigidly attaching said torque transmission equipment to said hull means.

10. The modular engine installation according to claim 9 wherein said torque transmission equipment includes a combined radial-axial thurst bearing fastened to said hull means, said thrust bearing having a specifically combined screw adjustment apparatus.

11. The modular engine intallation according to claim 2 including axial shock absorbers at least disposed to absorb shock on said upper portion and said lower portion of said prefabricated modular container; said axial shock absorbers acting fore and aft in a longitudinal direction of an axis of said ship, said axial shock absorbers being firmly attached to said hull means.

12. The modular engine installation according to claim 1 wherein said prefabricated modular container has a box frame.

13. The modular engine installation according to claim 12 wherein said prefabricated modular container has longitudinal floor beams, with machine foundations being disposed on said longitudinal floor beams.

14. The modular engine installation according to claim 13 wherein said longitudinal floor beams have box spars formed by welded-on sheets.

15. The modular engine installation according to claim 12 wherein said prefabricated modular container has a floor of metal.

16. The modular engine installation according to claim 15 wherein said metal floor comprises a metal sandwich construction.

17. The modular engine installation according to claim 12 wherein said box frame is lined with acoustic and thermal insulation material.

18. The modular engine installation according to claim 1 including means for mounting said engine means within said prefabricated modular container, said mounting means having resilient means for resiliently mounting said engine means.

19. The modular engine installation according to claim 18 wherein said engine means comprises an engine and a transmission, and wherein a ratio of the weight of said engine and said transmission to the remaining weight of said prefabricated modular container is in a range of about 3:1 to about 1:1.

20. The modular engine installation according to claim 19 wherein said ratio is about 2:1.

21. The modular engine installation according to claim 19 including a shaft connecting said engine and said transmission in said engine means, said connecting shaft having elastic adapters.

22. The modular engine installation according to claim 1 including a gasket, said gasket for being disposed between said removable cover means and its corresponding opening means in said hull means, when said removable cover means is disposed to close its corresponding opening means in said hull means of said ship.

23. The modular engine installation according to claim 22 wherein said gasket comprises a ring gasket.

24. The modular engine installation according to claim 1 including a transmission disposed within said prefabricated modular container; said transmission being disposed between said torque transferring means and said engine means.

25. The modular engine installation according to claim 1 for smaller ships, having a transmission and auxiliary equipment including exhaust equipment, air intake ducts and coolers, being disposed in said prefabricated modular container, in addition to said engine means.

26. The modular engine installation according to claim 1 wherein said prefabricated modular container is for installation horizontally in said ship; and including means for inclining said engine means obliquely backwards with respect to a stern portion of said hull means of said ship.

27. A modular engine installation for driving a ship through water, said ship having hull means with a plurality of decks and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means taking up torque from and weight of said modular container;

said engine means having means for transferring torque to said propeller means of said ship;

said propeller means being separate from said modular engine installation and being attached to said hull;

said prefabricated modular container having means for permitting said torque transferring means to pass therethrough;

removable cover means for covering said opening means in said hull means, at least when said prefabricated modular container is disposed in said hull means of said ship;

said prefabricated modular container being insertable in and completely removable from said opening means and said hull means of said ship, substantially in toto, with said engine means being contained in said prefabricated modular container, whereby time required for refitting of said modular ship engine installation is minimized;

support means disposed at said lower portion of said prefabricated modular container for substantially stabilizing said prefabricated modular container with respect to said hull means in a substantially horizontal direction, whereby lateral movements of said prefabricated modular container are minimized, and wherein said support means makes contact, when said modular container is installed in said ship, with bearing feet fastened to said hull means.

28. A modular engine installation for driving a ship through water, said ship having hull means and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means, and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said modular container;

said engine means having means for transferring torque to said propeller means of said ship;

said prefabricated modular container having means for permitting said torque transferring means to pass therethrough; and removable cover means for covering said opening means in said hull means, at least when said prefabricated modular container is disposed in said hull means of said ship;

said prefabricated modular container being insertable in and removable from said opening means in said hull means of said ship, substantially in toto, with said engine means being contained in said prefabricated modular container, whereby time required for refitting of said modular ship engine installation is minimized;

said ship having an engine room extending over several decks, and wherein said modular engine installation includes a plurality of modular containers for being disposed one above the other from an uppermost position to a lowermost position in said hull means.

29. The modular engine installation according to claim 28 wherein said plurality of modular containers have defined substantially horizontal cross sections of predetermined width and predetermined length;

said plurality of modular containers having predetermined container positions from said lowermost position to said uppermost position in said hull means;

said plurality of modular containers, from said lowermost position to said uppermost position, have increasingly greater predetermined width and length;

said opening means comprising a plurality of openings disposed one above the other in said hull means, said hull openings having predetermined widths and lengths to receive said plurality of modular containers;

said hull openings, from said lowermost position to said uppermost position, having increasingly greater predetermined widths and lengths;

said predetermined widths and lengths of said hull openings being adapted to receive and hold corresponding ones of said plurality of modular containers having corresponding said predetermined widths and lengths;

each of said plurality of modular containers enclosing a portion of said engine means.

30. The modular engine installation according to claim 29 wherein at least two of said plurality of modular containers are disposed in contact with one another one above the other, and wherein said lowermost modular container comprises a sealed unit, said modular container immediately above said lowermost modular container being suspended relative to said ship's deck by a surrounding elastic means.

31. A modular engine installation for driving a ship through water, said ship having hull means with a plurality of decks and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said prefabricated modular container;

said engine means having for transferring torque to said propeller means of said ship;

said propeller means being separate from said modular engine installation and being attached to said hull;

said prefabricated modular container having means for permitting said torque transferring means to pass therethrough;

removable cover means for covering said opening means in said hull means, at least when said prefabricated modular container is disposed in said hull means of said ship;

said prefabricated modular container being insertable in and completely removable from said opening means and said hull means of said ship, substantially in toto, with said engine means being contained in said prefabricated modular container, whereby time required for refitting of said modular ship engine installation is minimized, including force bearing means mounted rigidly to said ship;

a plurality of laterally-projecting brackets disposed along said upper portion of said prefabricated modular container, said plurality of laterally-projecting brackets being fastened to said force bearing means;

a plurality of shock absorbers disposed between said force bearing means and said laterally-projecting brackets; and said opening means in said hull means having a predetermined length and a predetermined width of a size sufficient to admit said prefabricated modular container having said laterally-projecting brackets attached thereto.

32. The modular engine installation according to claim 31 wherein said plurality of shock absorbers are vertically disposed and are also disposed at predetermined distances from one another.

33. A modular engine installation for driving a ship through water, said ship having hull means and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means, and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said modular container;

said engine means having means for transferring torque to said propeller means of said ship;

said prefabricated modular container having means for permitting said torque transferring means to pass therethrough; and removable cover means for covering said opening means in said hull means, at least when said prefabricated modular container is disposed in said hull means of said ship;

said prefabricated modular container being insertable in and removable from said opening means in said hull means of said ship, substantially in toto, with said engine means being contained in said prefabricated modular container, whereby time required for refitting of said modular ship engine installation is minimized;

said prefabricated modular container having an upper portion and a lower portion; said means for attaching being disposed on said upper portion of said prefabricated modular container whereby said prefabricated modular container is suspended from said hull means when installed, and wherein said hull means has torque transmission equipment for transmitting torque to said propeller means, and means for rigidly attaching said torque transmission equipment to said hull means;

said modular engine installation including force bearing means mounted rigidly to said ship;

a plurality of laterally-projecting brackets disposed along said upper portion of said prefabricated modular container, said plurality of laterally-projecting brackets being fastened to said force bearing means;

a plurality of shock absorbers disposed between said force bearing means and said laterally-projecting brackets;

said opening means in said hull means having a predetermined length and a predetermined width of a size sufficient to admit said prefabricated modular container having said laterally-projecting brackets attached thereto, and said hull means having an exterior upper deck, and wherein said force bearing means comprise oblong plates extending laterally under said laterally-projecting brackets; longitudinal spars attached to said force bearing means, said longitudinal spars being fastened to said exterior upper deck whereby said removable cover means for covering said opening means in said hull means is disposed flush with said exterior upper deck.

34. A modular engine installation for driving a ship through water, said ship having hull means and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means, and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said modular container;

said engine means having means for transferring torque to said propeller means of said ship;

said prefabricated modular container having means for permitting said torque transferring means to pass therethrough; and removable cover means for covering said opening means in said hull means, at least when said prefabricated modular container is disposed in said hull means of said ship;

said prefabricated modular container being insertable in and removable from said opening means in said hull means of said ship, substantially in toto, with said engine means being contained in said prefabricated modular container, whereby time required for refitting of said modular ship engine installation is minimized;

modular engine installation support means disposed at a lower portion of said prefabricated modular container for substantially stabilizing said prefabricated modular container with respect to said hull means in a substantially horizontal direction, whereby lateral movements of said prefabricated modular container are minimized, and wherein said lower support means comprises lateral support bearings, each said lateral support bearing having a bearing foot fastened to said hull means and a lateral shock absorber disposed between said bearing foot and said side means of said modular container.

35. The modular engine installation according to claim 34 wherein each said lateral shock absorber is fastened to its corresponding bearing foot, and wherein said prefabricated modular container has a shield plate disposed for making contact with its corresponding shock absorber.

36. A modular engine installation for driving a ship through water, said ship having hull means and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means, and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said modular container;

said engine means having means for transferring torque to said propeller means of said ship;

said prefabricated modular container having means for permitting said torque transferring means to pass therethrough; and removable cover means for covering said opening means in said hull means, at least when said prefabricated modular container is disposed in said hull means of said ship;

said prefabricated modular container being insertable in and removable from said opening means in said hull means of said ship, substantially in toto, with said engine means being contained in said prefabricated modular container, whereby time required for refitting of said modular ship engine installation is minimized;

said prefabricated modular container having an upper portion and a lower portion; said means for attaching being disposed on said upper portion of said prefabricated modular container whereby said prefabricated modular container is suspended from said hull means when installed;

said modular engine installation including axial shock absorbers at least disposed to absorb shock on one of said upper portions and said lower portions of said prefabricated modular container; said axial shock absorbers acting fore and aft in a longitudinal direction of an axis of said ship, said axial shock absorbers being firmly attached to said hull means; and said prefabricated modular container having axial shield plates; said axial shock absorbers being rigidly mounted on said hull means and only making contact with said prefabricated modular container, in operation, by making contact with said axial shield plates.

37. A modular engine installation for driving a ship through water, said ship having hull means and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means, and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said modular container;

said engine means having means for transferring torque to said propeller means of said ship;

said prefabricated modular container having means for permitting said torque transferring means to pass therethrough; and removable cover means for covering said opening means in said hull means, at least when said prefabricated modular container is disposed in said hull means of said ship;

said prefabricated modular container being insertable in and removable from said opening means in said hull means of said ship, substantially in toto, with said engine means being contained in said prefabricated modular container, whereby time required for refitting of said modular ship engine installation is minimized;

said prefabricated modular container having a box frame and longitudinal flloor beams, with machine foundations being disposed on said longitudinal floor beams;

said longitudinal floor beams having box spars; and wherein said box spars form oil tanks.

38. A modular engine installation for driving a ship through water, said ship having hull means and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means, and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said modular container;

said engine means having means for transferring torque to said propeller means of said ship;

said prefabricated modular container having means for permitting said torque transferring means to pass therethrough; and removable cover means for covering said opening means in said hull means, at least when said prefabricated modular container is disposed in said hull means of said ship;

said prefabricated modular container being insertable in and removable from said opening means in said hull means of said ship, substantially in toto, with said engine means being contained in said prefabricated modular container, whereby time required for refitting of said modular ship engine installation is minimized, and wherein said prefabricated modular container is lined by watertight means, including means for guiding said torque transferring means through said means for passing said torque transferring means, said guiding means comprising a bulkhead pipe fitting.

39. A modular engine installation for driving a ship through water, said ship having hull means and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means, and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said modular container;

said engine means having means for transferring torque to said propeller means of said ship;

said prefabricated modular container having means for permitting said torque transferring means to pass therethrough; and removable cover means for covering said opening means in said hull means, at least when said prefabricated modular container is disposed in said hull means of said ship;

said prefabricated modular container being insertable in and removable from said opening means in said hull means of said ship, substantially in toto, with said engine means being contained in said prefabricated modular container, whereby time required for refitting of said modular ship engine installation is minimized;

said hull means having a deck with a coaming surrounding said hull opening, said coaming having an uppermost portion;

said modular engine installation having force bearing means being disposed, when said prefabricated modular container is instaled, at the level of below said uppermost portion of said coaming, and said cover being fastened to an upper edge of said coaming.

40. A modular engine installation for driving a ship through water, said ship having hull means and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means, and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said modular container;

said engine means having means for transferring torque to said propeller means of said ship;

said prefabricated modular container having means for permitting said torque transferring means to pass therethrough; and removable cover means for covering said opening means in said hull means, at least when said prefabricated modular container is disposed in said hull means of said ship;

said prefabricated modular container being insertable in and removable from said opening means in said hull means of said ship, substantially in toto, with said engine means being contained in said prefabricated modular container, whereby time required for refitting of said modular ship engine installation is minimized;

said modular engine installation having an engine room of said ship extending vertically over several decks, said engine installation including several prefabricated modular containers located one above the other, whereby each said individual prefabricated modular container is suspended below a deck and contains a portion of said engine means.

41. A modular engine installation for driving a ship through water, said ship having full means and propeller means being attachable to said modular engine installation, said hull means having opening means for receiving said modular engine installation, said modular engine installation comprising:

engine means being a primary source of power for propelling said ship through water;

a prefabricated modular container for containing said engine means;

said prefabricated modular container having a bottom means, side means, and top means;

said side means having a plurality of portions, a first part of said portions being joined to one another to form corner portions therebetween; said bottom means having portions being joined to a second part of said portions of said side means to form corner portions between said bottom means and said side means;

means for attaching said prefabricated modular container to said hull means for taking up torque from and weight of said modular container;

said engine means having means for transferring torque to said propeller means of said ship;

said prefabricated modular container having means for permitting said torque transferring means to pass therethrough; and removable cover means for covering said opening means in said hull means, at least when said prefabricated modular container is disposed in said hull means of said ship;

said prefabricated modular container being insertable in and removable from said opening means in said hull means of said ship, substantially in toto, with said engine means being contained in said prefabricated modular container, whereby time required for refitting of said modular ship engine installation is minimized;

said modular engine installation including means for mounting said engine means within said prefabricated modular container, said mounting means having resilient means for resiliently mounting said engine means;

said modular engine installation including ballast, and wherein the weight of said prefabricated modular container is increased to a predetermined value by said ballast.

42. The modular engine installation according to claim 41 wherein said ballast is cast concrete fastened in a lower portion of said prefabricated modular container.

* * * * *